United States Patent [19]

Murakami et al.

[11] Patent Number: 5,064,019

[45] Date of Patent: Nov. 12, 1991

[54] ELECTROACOUSTIC DIAPHRAGM AND METHOD FOR MAKING SAME

[75] Inventors: Mutsuaki Murakami, Tokyo; Susumu Yoshimura, Yokohama, both of Japan

[73] Assignees: Matsushita Electric Industrial Co., Ltd.; Research Development Corporation of Japan, both of Japan

[21] Appl. No.: 334,519

[22] Filed: Apr. 7, 1989

[30] Foreign Application Priority Data

Apr. 8, 1988 [JP] Japan ..... 63-87517

[51] Int. Cl.[5] ..... G10K 13/00; H04R 7/00

[52] U.S. Cl. ..... 181/170

[58] Field of Search ..... 181/167, 170

[56] References Cited

U.S. PATENT DOCUMENTS 4,221,773 9/1980 Tsukagoshi et al. ..... 181/167 X

FOREIGN PATENT DOCUMENTS 0130013 11/1978 Japan ..... 181/167

0033237 8/1980 Japan ..... 181/170

60-181129 9/1985 Japan .

*Primary Examiner*—Brian W. Brown

*Attorney, Agent, or Firm*—Lowe, Price, LeBlanc, Becker & Shur

[57] ABSTRACT

An electroacoustic diaphragm is provided, which diaphragm comprising a pyrolytic graphite film obtained from a polymer selected from polyoxadiazole, an aromatic polyimide obtained by polycondensation or pyromellitic acid and an aromatic diamine, polybenzthiazole, polybenzbisthiazole, polybenzoxazole, polybenzbisoxazole, poly(pyromellitimide), poly(m-phenyleneisophthalamide). poly(m-phenylenebenzoimidazole), poly(m-phenylenebenzobisimidazole), polythiazole and poly-p-phenylenevinylene. The graphite film has a discontinuous layer of a polymeric material formed on and in the film whereby not only good electroacoustic characteristics, but also good mechanical strength and good adhesion of an adhesive applied thereof are obtained. A method for fabricating such diaphragm is also described.

5 Claims, 1 Drawing Sheet

D

D

D

ELECTROACOUSTIC DIAPHRAGM AND METHOD FOR MAKING SAME

BACKGROUND OF THE INVENTION

1. Field of the Invention

This invention relates to carbonaceous diaphragms which exhibit electroacoustic characteristics suitable for use in speakers, microphones and the like and a method for making such diaphragms.

2. Description of the Prior Art

A recent growing tendency toward digitalization of acoustic apparatus requires very high performance of diaphragms for use in speakers or the like. The diaphragm adapted for this purpose should have a small degree of deformation when applied with an external force with a small degree of sound distortion and is able to reproduce a clear sound whose range is wide. To this end, it is necessary that the diaphragm be light in weight and have a good modulus of elasticity and good rigidity. More particularly, the diaphragm should have (1) a large Young's modulus (E), (2) a small density ($\rho$), (3) a large sound velocity (transmission velocity V of sound wave), (4) an appropriate value of internal loss (tan $\delta$). It will be noted that the values of V. E and $\rho$ have the relationship that $V=\sqrt{E/\rho}$.

Aside from the above physical properties, it is important that the fabrication be easy and that the diaphragm be stable against heat and humidity.

The currently employed materials for the diaphragm are, for example, paper, plastic resins, aluminium, titanium, magnesium, berylium, boron, silica and the like. These materials or metals have been employed singly or in combination with glass fibers, carbon fibers and the like. Alternatively, some of them have been used in the form of metal alloys. However, paper or plastic resins are not satisfactory for use as a diaphragm with respect to the physical and acoustic characteristics such as the Young's modulus, density and sound velocity. In particular, the frequency characteristic in a high frequency range is very poor, which makes it difficult to obtain a clear sound when these materials are applied as a diaphragm of a tweeter. On the other hand, aluminium, magnesium and titanium are excellent in sound velocity but has so small an internal loss of the vibrations that a high-frequency resonance phenomenon undersirably appears. Thus, these metals are not satisfactory for use as a diaphragm for high-frequency service. Moreover, boron and berylium exhibit better physical properties than those of the above-mentioned materials or metals and can reproduce a sound of good quality when applied as a diaphragm. However, boron or berylium is very expensive and has very poor workability.

On the other hand, diaphragms made of carbon or carbonaceous materials have been recently developed in order to overcome the drawbacks involved in the above-described materials. As is known in the art, graphite has a number of good physical properties which are favorable when graphite is applied as a diaphragm. Several techniques of making diaphragms from graphite or other carbonaceous materials have been proposed including (1) a technique wherein graphite powder is dispersed in a polymer resin or resins, (2) a technique using a polymer sheet which has been carbonized and graphitized, and (3) a technique which makes use of a graphite/carbon combination which is obtained by firing a sheet of graphite powder and a polymer resin or resins.

A typical example of the diaphragm obtained by (1) is one which is made of a dispersion of graphite powder in polyvinyl chloride resin matrix. This diaphragm is readily influenced by humidity and temperature and its vibration characteristic considerably deteriorates at temperatures over 30° C.

With the technique (2), several types of polymer films have been investigated but initially expected characteristics could not be obtained because plastic films used are hard to graphitize. For example, the resins including epoxy resins, phenolic resins, furfuryl alcohol resins have been used for this purpose. These plastic resins exhibit a low rate of graphitization and are shrunk to an appreciable extent when thermally treated, so that defects such as deformation, crackings and the like are often produced. This technique does not ensure fabrication of a diaphragm of graphite or a carbonaceous material having good characteristics under well-controlled quality control.

The technique (3) includes a method wherein a liquid component of a pitch obtained by cracking of crude oil is mixed with graphite powder and the mixture is thermally treated for carbonization, and a method wherein a monomer or oligomer capable of yielding a thermosetting resin is used as a binder for graphite powder and a thermoplastic resin having functional groups capable of thermal decomposition and crosslinkage under heating conditions are mixed with graphite powder as a binder, followed by thermal carbonization. These methods have been developed in order to increase a yield of graphite or carbon and to prevent shrinkage or deformation when thermally treated. A diaphragm obtained from th resultant graphite exhibits good electroacoustic characteristics.

However, the methods of the technique (3) require complicated fabrication procedures which are inconvenient for industrial mass production. In order to industrially obtain the pitch and liquid component by cracking of crude oil in the former method, a very complicated procedure of thermal treatment at high temperatures and fractional solvent extraction is necessary. The latter method requires a high technic wherein graphite powder and a binder are sufficiently kneaded by the use of a kneader operating under high shear force conditions. Subsequently, cleft graphite crystals and the binder resin are strongly dispersed to impart affinity for each other by mechanochemical reaction thereby causing the crystal planes of the graphite to be oriented along the direction of the sheet plane. Although the diaphragm obtained using the resultant combination has very excellent characteristics, those characteristics are slightly inferior to those of a berylium diaphragm which is believed to have the highest characteristics attained among existing diaphragms. In addition, the modulus of elasticity of the combination is significantly poorer than the theoretical value of 1020 GPa. of a graphite single crystal.

SUMMARY OF THE INVENTION

An object of the invention is to provide a carbonaceous or graphite diaphragm which has good mechanical strength and good electroacoustic characteristics as will not be expected by prior art diaphragms.

Another object of the invention is to provide a carbonaceous or graphite diaphragm which ensures good adhesion of adhesives and can be manipulated as desired.

A further object of the invention is to provide a method for fabricating a graphite diaphragm which is very simple in procedure thereby producing the diaphragm having excellent mechanical and electroacoustic properties.

A still further object of the invention is to provide a method for fabricating a graphite diaphragm by a simple and industrially advantageous manner.

The diaphragm according to the invention comprises a pyrolytic graphite film obtained from a polymer selected from polyoxadiazole, an aromatic polyimide obtained by polycondensation of pyromellitic acid and an aromatic diamine, polybenzthiazole, polybenzbisthiazole, polybenzoxazole, polybenzbisoxazole, poly(pyromellitimide), poly(m-phenyleneisophthalamide), poly(m-phenylenebenzoimidazole), poly(m-phenylenebenzobisimidazole), polythiazole and poly-p-phenylenevinylene and a discontinuous layer of a polymeric material formed on and in the graphite film. The polymeric material is formed by impregnation in the graphite film after dissolution in a suitable solvent.

The diaphragm is fabricated by a method which comprises providing a film of a polymer defined above, subjecting the film to pyrolysis or thermal treatment at a temperature of not lower than 2000° C. in vacuum or in an inert gas for a time sufficient for the pyrolysis to obtain a graphite film, impregnating a polymeric material in the graphite film to form a discontinuous layer of the polymeric material on or in the graphite film, and drying the thus impregnated film.

DETAILED DESCRIPTION AND EMBODIMENTS OF THE INVENTION

Figure 1:
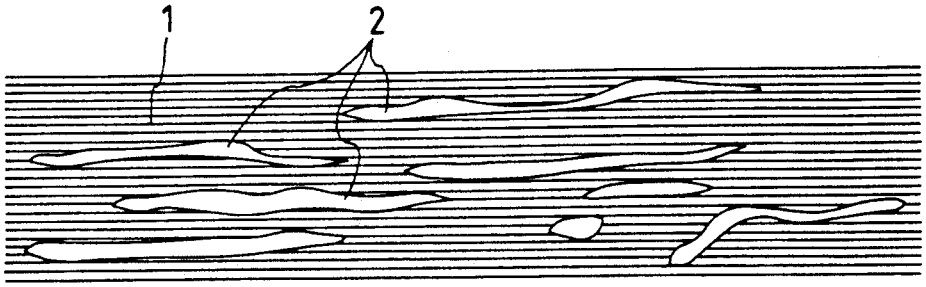
FIG. 1 is a schematic sectional view of part of a diaphragm fabricated according to the invention.

Reference is now made to the accompanying drawings. In FIG. 1, there is generally shown part of a diaphragm D which includes a graphite film 1 and a polymer resin 2 formed on and in the graphite film 1 in the form of, for example, islands.

The graphite film 1 used in the practice of the invention is obtained from a film of a polymer which is selected from polyoxadiazole, an aromatic polyimide obtained by polycondensation of pyromellitic acid and an aromatic diamine, polybenzthiazole, polybenzbisthiazole, polybenzoxazole, polybenzbisoxazole, poly(pyromellitimide), poly(m-phenyleneisophthalamide), poly(m-phenylenebenzimidazole), poly(m-phenylenebenzbisimidazole), polythiazole and poly-p-phenylenevinylene. These polymers are known in the art. In particular, the aromatic polyimide useful in the present invention is described, for example, in Japanese Laid-open Patent Application No. 60-181129, which is incorporated herein by reference. In the practice of the invention, a preferred aromatic polyimide is a poly-N,N'-(P,P'-oxydiphenylene)pyromellitimide.

For the formation of the graphite film, the polymer film is pyrolyzed or thermally treated at a temperature of not lower than 2000° C. in vacuum or in an inert gas such as nitrogen, argon or the like for a time sufficient for the pyrolysis. The time is generally in the range of from 10 minutes to 10 hours. By the pyrolysis, the polymer film is carbonized to give a graphite film which is slightly reduced in size. When the graphite film obtained is used as a diaphragm, the graphite film should preferably have a thickness of from 5 to 50 micrometers in view of the mechanical and electroacoustic characteristics.

Of the graphite films, those films obtained from polyoxadiazole, polybenzimidazole and the aromatic polyimide are preferred because of their high sound velocities.

The diaphragm of the invention should further comprise a polymeric material applied to the graphite film. The polymeric material is formed in or on the graphite film by which the mechanical strength, electroacoustic characteristics and the adhesion of an adhesive to the graphite film can be significantly improved. The polymeric material is formed, for example, as islands which mean discontinuous layers. For this purpose, carbonaceous substances such as pitches, organic polymers and the like may be used provided that they high high affinity for the graphite film sufficient to cause the impregnation. If the affinity is low, the polymeric materials tend to come off from the graphite film after application and are not impregnated. Preferably, epoxy resins, polyorganosiloxane resins, cyanoacrylate resins, and furan resins are used. Useful epoxy resins include, for example, Sumiepoxy ELM 120 available from Sumitomo Chem. Co., Ltd. The polyorganosiloxane is, for example, Silaplane available from Chisso Corporation.

The cyanoacrylate resin is, for example, one which is available under the name of Aron α from Toa Synthetic Chem. Co., Ltd. of Japan. The furan resin is a product of a furfuryl alcohol oligomer which has been thermally polymerized after application. The amount of the polymer resin to be applied to the graphite film may vary depending upon the type of resin and should be sufficient to improve physical properties including adhesiveness. The amount is generally in the range of from 0.2 to 25 wt %. When the preferred resins are used, the amount is in the range of from 0.5 to 15 wt % of the graphite film for the epoxy resin, from 0.5 to 25 wt % for the organosiloxane resin, from 0.2 to 15 wt % for the cyanoacrylate resin, and from 1.0 to 20 wt % for the furan resin. Less amounts for the respective resins are unfavorable because physical strength is not improved significantly. On the other hand, when larger amounts are used, there is the tendency that the electroacoustic characteristics including the sound velocity, Young's modulus and the like lower.

Figure 2:
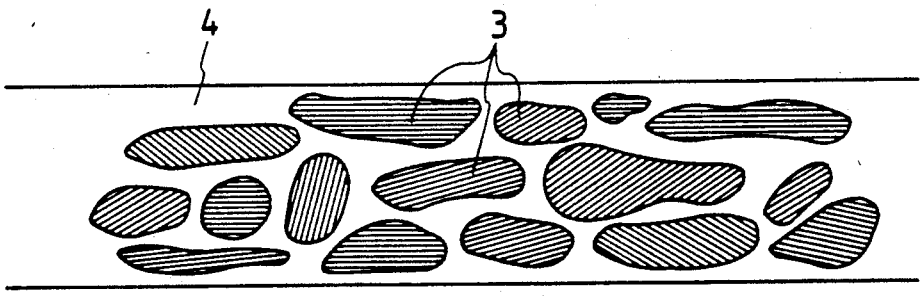
FIG. 2 PRIOR ART
FIG. 2 is a schematic sectional view of part of a known diaphragm using a dispersion of graphite powder in a plastic resin.

The diaphragm of the invention may be considered to have a structure similar to known diaphragms obtained from graphite powder and a polymer resin. However, the diaphragm of the invention is completely different from the known diaphragms. Part of a typical known diaphragm is shown in FIG. 2, in which a diaphragm D includes islands of a graphite powder 3 dispersed in a polymer resin matrix 4. This is completely different from the diaphragm of the invention shown in FIG. 1, in which graphite is a matrix in which a polymeric material is contained. With the diaphragm of the invention, the characteristics of the diaphragm depend greatly on the graphite. This is why the diaphragm of the invention is better than the known diaphragm.

In the above embodiment, the graphite film is applied or impregnated with a polymeric material. The graphite film obtained from the aromatic polyimide or polyoxadiazole shows better mechanical and electroacoustic characteristics without application of any polymeric material than the graphite films obtained from the other polymers. The diaphragm using this graphite film without application of any polymeric materials is also within the scope of the invention.

Fabrication of the diaphragm according to the invention is described.

In the method of the invention, a film of the polymer defined before is first provided. This film is subjected to pyrolysis at temperatures not lower than 2000° C. in vacuum or in an inert gas for a time set forth before. As stated in examples, the polymer film may be first thermally pretreated at temperatures not higher than 1000° C. in an inert gas. The resultant film is relatively fragile and may be reduced in size. Subsequently, the pretreated film is pyrolyzed at temperatures of not lower than 2000° C., e.g. at 3000° C. For the pyrolysis, the polymer film or pre-treated film is usually sandwiched between graphite plates so as to prevent breakage during the pyrolysis. The pyrolyzing conditions may be varied during the course of the pyrolysis. Preferably, the film is thermally treated in vacuum up to a temperature not higher than 2000° C., followed by further treatment in an inert gas, such as argon, at a temperature higher than 2000° C. The heating rate is not critical but is preferably in the range of from 1° C./minute to 50° C./minute. The polymer or pretreated film is substantially graphitized for a time of from 10 minutes to 10 hours. The resultant film is relatively flexible in nature.

This graphite film has good electroacoustic characteristics but has relatively poor mechanical strength and adhesion of an adhesive.

In the practice of the invention, the problem is solved by applying the graphite film with a solution of a polymeric material to cause the polymer to be formed as islands in and/or on the graphite film.

A solution of a polymer, which is preferably an epoxy resin, an organosiloxane resin, a furan resin or a cyanoacrylate resin as stated before, is prepared. The solvents used to prepare the solution may be any ones which are able to dissolve an intended polymer. Examples of such solvents include ketones such as acetone, ethers such as ethylene glycol monoalkyl ethers, hydrocarbons such as toluene, 1,4-dichlorobenzene and the like, alcohols such as isopropyl alcohol and NMP, and the like. When the polymer is a liquid having a low viscosity, it may be used without dilution with any solvent. For instance, an oligomer of a furfuryl alcohol may be applied as it is, after which it is polymerized by application of heat. However, it is usual to dissolve the polymer in a solvent. This is advantageous in that the amount of the polymer being applied or impregnated can be relatively precisely controlled by controlling the concentration in the solution. For facilitating the impregnation, the applied graphite film may be placed under reduced pressure conditions, under which the applied polymer may be conveniently included in the graphite film as shown in FIG. 1.

The applied film is dried or thermally treated at temperatures which may depend upon the type of applied polymer resin. In general, the temperatures are appropriately in the range of not higher than 1000° C., preferably from 200° to 800° C. Thus, a graphite film applied or impregnated with a polymer resin can be obtained. This film has good electroacoustic characteristics and good mechanical strength. In addition, the film has good adhesion of an adhesive, which is particularly effective for application in speaker or microphone systems.

The applied graphite film may be fabricated in any size and can be applied as a diaphragm for acoustic devices without difficulties.

The present invention is more particularly described by way of examples.

EXAMPLE 1

A 50 μm thick polyimide film (Kapton H film, available from Du Pont De Nemours & Co.) was cut into a piece having a size of 80 mmΦ. This piece was placed between quartz plates and thermally treated in an electric furnace at a temperature of 1000° C. in an atmosphere of nitrogen at a heating rate of 20° C./minute. After the treatment at 1000° C. for 10 minutes, the film was cooled down to room temperature and removed from the furnace. The resultant film was shrunk to an extent of 60 mmΦ and was relatively hard and brittle.

This sample was placed between graphite plates and subjected to pyrolysis in a carbon heater furnace, Model 46-5, available from Shinsei Electric Furnace Co., Ltd. of Japan while heating up to 3000° C. In this pyrolysis, the film was first heated up to 2000° C. in vacuum at a heating rate of 40° C./minute and then in an atmosphere of argon at a heating rate of 40° C./minute up to 3000° C. The film was kept at the maximum temperature for 1 hour, after which it was cooled down to room temperature. The resultant graphite film was relatively flexible and soft. This film was subjected to measurement of physical properties by the use of the Dynamic Modulus Tester of Toyo Seiki K. K. of Japan.

The above procedure was repeated at different pyrolysis temperatures.

The results of the measurement of the graphite films are shown in Table 1. Moreover, the characteristics of known materials used as a diaphragm were also subjected to measurement of the characteristics. These results are shown in Table 2.

TABLE 1

| Thermal Treatment Temp. (°C.) | Sound Velocity (Km/sec.) | Young's Modulus (GPa) | Density (g/cm$^3$) | Internal Loss tan δ |
|---|---|---|---|---|
| 1400 | 4.6 | 31 | 1.5 | $2.0 \times 10^{-2}$ |
| 1600 | 3.7 | 21 | 1.5 | $3.0 \times 10^{-2}$ |
| 1800 | 4.4 | 30 | 1.6 | $2.2 \times 10^{-2}$ |
| 2000 | 7.4 | 76 | 1.4 | $2.0 \times 10^{-2}$ |
| 2200 | 7.9 | 100 | 1.6 | $4.2 \times 10^{-2}$ |
| 2400 | 9.4 | 158 | 1.8 | $3.6 \times 10^{-2}$ |
| 2600 | 12.3 | 364 | 2.4 | $3.3 \times 10^{-2}$ |
| 2800 | 18.1 | 692 | 2.1 | $2.3 \times 10^{-2}$ |
| 3000 | 18.9 | 750 | 2.1 | $2.2 \times 10^{-2}$ |

TABLE 2

| Material | Sound Velocity (Km/sec.) | Young's Modulus (GPa) | Density (g/cm$^3$) | Internal Loss tan δ |
|---|---|---|---|---|
| Paper (pulp) | 1.0–2.0 | 0.2–4.0 | 0.2–0.6 | $2–6 \times 10^{-2}$ |
| Polypropylene | 1.3 | 1.5 | 0.9 | $6.0 \times 10^{-2}$ |
| Aluminium | 5.1 | 70 | 2.7 | $2–3 \times 10^{-3}$ |
| Titanium | 4.9 | 110 | 4.5 | " |
| Magnesium | 5.1 | 44 | 1.7 | " |
| Berylium | 12.2 | 270 | 1.8 | " |
| Graphite/carbon | 11.0 | 175 | 1.45 | $9 \times 10^{-3}$ |

The sound velocity and Young's modulus of the graphite films obtained from the polyimide film sharply increase at thermal treatment temperatures near 2000°

C. When pyrolyzed at 2600° C., the sound velocity is 12.3 Km/second and the Young's modulus is 364 GPa. These values are higher than those of berylium, as particularly shown in Table 2, which has been accepted as having the most excellent characteristics for diaphragm among existing diaphragm materials. Thus, it will be seen that the pyrolysed polyimide film has good characteristics as a diaphragm. The characteristics of the pyrolysed film are more improved at higher temperatures, e.g. the Young's modulus reaches 750 GPa when the temperature is 3000° C. This value is as high as 74% of the theoretical value of single crystal graphite which is 1020 GPa.

As will be appreciated from the above, when the polyimide film is thermally treated at temperatures of not lower than 2000° C., a graphite film having good characteristics can be obtained by a very simple procedure as compared with complicated fabrication procedures of known techniques as stated before.

The graphite films obtained above are relatively low in mechanical strength and adhesion of an adhesive. This is solved by application or impregnation of an organic polymer. This is described below.

The graphite film obtained by the thermal treatment of the polyimide film at 2800° C. was immersed in each of solutions of an epoxy resin (Sumiepoxy ELM 120, available from Sumitomo Chem. Co., Ltd.) dissolved in a mixed solvent of ethylene glycol monomethyl ether (methyl cellosolve) and acetone in different concentrations, thereby changing an amount of the epoxy resin impregnated in the graphite film. After the impregnation, teach film was dried at 100° C. for 1 hour and thermally treated at 150° C. for further 1 hour. After the drying treatment, the film was weighed to determined an amount of the impregnated resin. In this manner, the graphite films impregnated from 0 to 100 wt % based on the film were made. These films were subjected to measurement of the sound velocity, Young's modulus, internal loss and tensile strength. The results are shown in Table 3 below.

TABLE 3

| Amount of Impregnated resin (wt %) | Sound velocity (Km/sec.) | Young's Modulus (GPa) | Internal Loss tan δ | Tensile Strength (MPa) |
|---|---|---|---|---|
| 0 | 18.1 | 692 | $2.3 \times 10^{-2}$ | 85 |
| 0.2 | 18.1 | 690 | $2.3 \times 10^{-2}$ | 85 |
| 0.5 | 17.9 | 680 | $2.8 \times 10^{-2}$ | 180 |
| 5 | 16.8 | 590 | $3.1 \times 10^{-2}$ | 300 |
| 15 | 12.2 | 380 | $2.3 \times 10^{-2}$ | 500 |
| 25 | 7.5 | 72 | $2.0 \times 10^{-2}$ | 600 |
| 100 | 3.5 | 25 | $1.8 \times 10^{-2}$ | 600 |

As will be apparent from the above results, when the amount of the epoxy resin exceeds 15 wt % based on the film, the characteristics including the Young's modulus abruptly decrease. On the other hand, when the amount is less than 0.5 wt %, little improvement of the tensile strength is expected. From this, the amount of the epoxy resin is conveniently in the range of from 0.5 to 15 wt %.

When the impregnated diaphragm is applied as a diaphragm, the adhesion of various types of adhesives and particularly an epoxy resin adhesive is improved remarkably. This makes it very easy to assemble electroacoustic devices such as speakers, microphones and the like.

EXAMPLE 2

A 50 micrometer thick polyoxadiazole film (available from Furukawa Electric Ind. Co., Ltd.) was cut into pieces having a size of 60 mmΦ. This piece was placed between quartz plates and thermally treated in an electric furnace (Model LTF-8, available from Sankyo Electric Furnace Co., Ltd. of Japan). The thermal treatment was effected at 1000° C. while heating at a rate of 20° C. in an atmosphere of nitrogen and the sample was kept at 1000° C. for 10 minutes, after which it was cooled down to room temperature and removed from the furnace. The resultant sample was reduced in size to an extent of 48 mmΦ and was relatively hard and brittle.

This sample was placed between graphite plates and subjected to pyrolysis in a carbon heater furnace, Model 46-5, available from Shinsei Electric Furnace Co., Ltd. of Japan while heating up to 2800° C. In this pyrolysis, the film was first heated up to 2000° C. in vacuum at a heating rate of 40° C./minute and then in an atmosphere of argon at a heating rate of 40° C./minute up to 3000° C. The film was kept at the maximum temperature for 1 hour, after which it was cooled down to room temperature. The resultant graphite film was relatively flexible and soft. This film was subjected to measurement of physical properties by the use of the Dynamic Modulus Tester of Toyo Seiki K. K. of Japan.

The above procedure was repeated at different thermal treatment temperatures.

From the above test, it was found that the graphite films thermally treated over 2000° C., inclusive, had large sound velocity and Young's modulus with a small density, so that they were suitable as a diaphragm. For instance, the graphite film obtained at a thermal treatment temperature of 2800° C. had a sound velocity of 8.0 Km/second, a Young's modulus of 140 GPa, a density of 2.2 g/cm$^3$ and an internal loss of $7.7 \times 10^{-2}$.

Subsequently, the graphite films were each immersed in an oligomer of furfuryl alcohol (Hitafuran 302, available from Hitachi Chem. Ind. Co., Ltd.), followed by polymerization by application of heat. The film was thermally treated at 800° C. for 40 minutes in an electric furnace (Model UTF-8, available from Sankyo Electric Furnace Co., Ltd.) After the thermal treatment, the respective films were weighed to determined an amount of the impregnated resin. These films were subjected to measurement of the sound velocity, Young's modulus, internal loss and tensile strength. The results are shown in Table 4 below.

TABLE 4

| Amount of Impregnated resin (wt %) | Sound velocity (Km/sec.) | Young's Modulus (GPa) | Internal Loss tan δ | Tensile Strength (MPa) |
|---|---|---|---|---|
| 0 | 8.0 | 140 | $7.7 \times 10^{-2}$ | 80 |
| 0.2 | 9.5 | 175 | $4.0 \times 10^{-2}$ | 85 |
| 0.5 | 11.0 | 260 | $3.1 \times 10^{-2}$ | 280 |
| 5 | 16.0 | 400 | $2.8 \times 10^{-2}$ | 400 |
| 20 | 12.0 | 310 | $2.8 \times 10^{-2}$ | 460 |
| 30 | 7.0 | 70 | $2.3 \times 10^{-2}$ | 520 |
| 50 | 5.2 | 50 | $2.0 \times 10^{-2}$ | 600 |
| 100 | 3.1 | 25 | $1.8 \times 10^{-2}$ | 600 |

As will be apparent from the above result, the amount of the furfuryl alcohol polymer is suitably in the range of from 0.5 to 20 wt % based on the film.

EXAMPLE 3

Graphite films were obtained by treating polyoxadiazole films at a temperature of 2800° C. in a manner similar to Example 2 and then impregnated with an organosiloxane polymer in different amounts.

After completion of the impregnation, the films were each dried at 100° C. for 1 hour and thermally treated at 200° C. for 2 hours. The resultant films were subjected to measurement of characteristic properties as in the foregoing examples. As a result, it was found that when the amount of the polymer was in the range of from 0.5 to 25 wt % based on the film, the sound velocity was not lower than 10 Km/second and the Young's modulus was not less than 200 GPa. The tensile strength was not less than 180 MPa when the amount of the impregnated resin was not less than 0.5 wt %. The thus treated films had all good adhesion of adhesives thereto.

EXAMPLE 4

Graphite films were obtained by treating polyoxadiazole films at a temperature of 2800° C. in a manner similar to Example 2 and then immersed in solutions of a cyanoacrylate resin (Aron $\alpha$) in an acetone solvent with different concentrations. After removal of the films from the respective solutions, the films were dried at 80° C. for 1 hour. The resultant films were subjected to measurement of characteristic properties as in the foregoing examples. As a result, it was found that when the amount of the resin was in the range of from 0.2 to 20 wt %, the sound velocity was not lower than 10 Km/second and the Young's modulus was not lower than 200 GPa. The tensile strength was 180 MPa or over when the amount was not less than 0.2 wt %. The adhesion of adhesives to the impregnated films was good.

EXAMPLE 5

The general procedure of Example 1 was repeated except that a polybenzimidazole film was used and thermally treated at a final temperature of 2800° C. The resultant film has a sound velocity of 5.0 Km/second, a Young's modulus of 120 GPa, an internal loss of $2.6\times10^{-2}$ and a tensile strength of 350 MPa.

The film was impregnated with an epoxy resin in the same manner as in Example 1 in different amounts.

When the amount of the impregnated resin was in the range of from 0.5 to 15 wt %, the sound velocity was not lower than 10 Km/second, the Young's modulus was not lower than 200 GPa and the tensile strength was not less than 400 MPa.

It was confirmed that when the polybenzimidazole was thermally treated at not lower than 2000° C., similar results were obtained.

The general procedure of the foregoing examples was repeated using 50 micrometer thick films of polybenzbisthiazole, polybenzoxazole, polybenzbisoxazole, poly(pyromellitimide), poly(m-phenyleneisophthalamide), poly(m-phenylenebenzimidazole), poly(m-phenylenebenzbisimidazole) and polythiazole. Similar results were obtained when these films were thermally treated at temperatures not lower than 2000° C.

What is claimed is:

1. An electroacoustic diaphragm which comprises a pyrolitic graphite film having a modulus of elasticity and rigidity suitable to exhibit electroacoustic characteristics obtained from a polymer selected from the group consisting of polyoxadiazole, an aromatic polyimide obtained by polycondensation of pyromellitic acid and an aromatic diamine, polybenzthiazole, and an aromatic diamine, polybenzthiazole, polybenzbisthiazole, polybenzoxazole, polybenzbisoxazole, poly(pyromellitimide), poly(m-phenyleneisophthalamide), poly(m-phenylenebenzoimidazole), poly(m-phenylenebenzobisimidazole), polythiazole and poly-p-phenylenevinylene, and a discontinuous layer of a polymer resin formed on and in the graphite film, wherein said discontinuous layer is in the form of islands formed on and in the graphite film, wherein said discontinuous layer is made of a polymer selected from an epoxy resin, an organosiloxane resin, a cyanoacrylate resin and a furan resin, wherein said polymer is an epoxy resin and is used in an amount of from 0.5 to 15 wt % of the graphite film, and said electroacoustic diaphragm has a tensile strength of from 180 to 500 Mpa, a Young's modulus of from 380 to 680 GPa., and said electroacoustic diaphragm has a measured sound velocity from 12.2 to 17.9 Km/sec.

2. An electroacoustic diaphragm which comprises a pyrolitic graphite film having a modulus of elasticity and rigidity suitable to exhibit electroacoustic characteristics obtained from a polymer selected from the group consisting of polyoxadiazole, an aromatic polyimide obtained by polycondensation of pyromellitic acid and an aromatic diamine, polybenzthiazole, and an aromatic diamine, polybenzthiazole, polybenzbisthiazole, polybenzoxazole, polybenzbisoxazole, poly(pyromellitimide), poly(m-phenyleneisophthalamide), poly(m-phenylenebenzoimidazole), poly(m-phenylenebenzobisimidazole), polythiazole and poly-p-phenylenevinylene, and a discontinuous layer of a polymer resin formed on and in the graphite film, wherein said discontinuous layer is in the form of islands formed on and in the graphite film, wherein said discontinuous layer is made of a polymer selected from an epoxy resin, an organosiloxane resin, a cyanoacrylate resin and a furan resin, wherein said polymer is an epoxy resin and is used in an amount of from 0.5 to 15 wt % of the graphite film, and said electroacoustic diaphragm has a tensile strength not less than 400 MPa, a Young's modulus of not less than 200 GPa, and said electroacoustic diaphragm has a measured sound velocity not less than 10 Km/sec.

3. An electroacoustic diaphragm which comprises a pyrolitic graphite film having a modulus of elasticity and rigidity suitable to exhibit electroacoustic characteristics obtained from a polymer selected from the group consisting of polyoxadiazole, an aromatic polyimide obtained by polycondensation of pyromellitic acid and an aromatic diamine, polybenzthiazole, and an aromatic diamine, polybenzthiazole, polybenzbisthiazole, polybenzoxazole, polybenzbisoxazole, poly(pyromellitimide), poly(m-phenyleneisophthalamide), poly(m-phenylenebenzoimidazole), poly(m-phenylenebenzobisimidazole), polythiazole and poly-p-phenylenevinylene, and a discontinuous layer of a polymer resin formed on and in the graphite film, wherein said discontinuous layer is in the form of islands formed on and in the graphite film, wherein said discontinuous layer is made of a polymer selected from an epoxy resin, an organosiloxane resin, a cyanoacrylate resin and a furan resin, wherein said polymer is an organosiloxane resin and is used in an amount from 0.5 to 25 wt % of the graphite film, and said electroacoustic diaphragm has a measured sound velocity of not less than 10 Km/sec., a Young's modulus of not less than 200 GPa, and the tensile strength of said electroacoustic diaphragm is not less than 180 MPa.

4. An electroacoustic diaphragm which comprises a pyrolitic graphite film having a modulus of elasticity and rigidity suitable to exhibit electroacoustic characteristics obtained from a polymer selected from the group consisting of polyoxadiazole, an aromatic polyimide obtained by polycondensation of pyromellitic acid and an aromatic diamine, polybenzthiazole, and an aromatic diamine, polybenzthiazole, polybenzbisthiazole, polybenzoxazole, polybenzbisoxazole, poly(pyromellitimide), poly(m-phenyleneisophthalamide), poly(m-phenylenebenzoimidazole), poly(m-phenylenebenzobisimidazole), polythiazole and poly-p-phenylenevinylene, and a discontinuous layer of a polymer resin formed on and in the graphite film, wherein said discontinuous layer is in the form of islands formed on and in the graphite film, wherein said discontinuous layer is made of a polymer selected from an epoxy resin, an organosiloxane resin, a cyanoacrylate resin and a furan resin, where said polymer is a cyanoacrylate resin and is used in a amount of from 0.2 to 20 wt % of the graphite film, and said electroacoustic diaphragm has a measured sound velocity of not less than 10 Km/sec., a Young's modulus of not less than 200 GPa, and the tensile strength of said electroacoustic diaphragm is 180 MPa or greater.

5. An electroacoustic diaphragm which comprises a pyrolitic graphite film having a modulus of elasticity and rigidity suitable to exhibit electroacoustic characteristics obtained from a polymer selected from the group consisting of polyoxadiazole, an aromatic polyimide obtained by polycondensation of pyromellitic acid and an aromatic diamine, polybenzthiazole, and an aromatic diamine, polybenzthiazole, polybenzbisthiazole, polybenzoxazole, polybenzbisoxazole, poly(pyromellitimide), poly(m-phenyleneisophthalamide), poly(m-phenylenebenzoimidazole), poly(m-phenylenebenzobisimidazole), polythiazole and poly-p-phenylenevinylene, and a discontinuous layer of a polymer resin formed on and in the graphite film, wherein said discontinuous layer is in the form of islands formed on and in the graphite film, wherein said discontinuous layer is made of a polymer selected from an epoxy resin, an organosiloxane resin, a cyanoacrylate resin and a furan resin, polymer is a furan resin and is used in an amount from 0.5 to 20 wt % of the graphite film, and said electroacoustic diaphragm has a tensile strength from 280 to 460 MPa, Young's modulus of from 260 to 400 GPa., and said electroacoustic diaphragm has a measured sound velocity from 11.0 to 16.0 Km/sec.

* * * * *